US005190179A

United States Patent [19]

Richter et al.

[11] Patent Number: 5,190,179

[45] Date of Patent: Mar. 2, 1993

[54] COLLAPSIBLE SHIPPING CONTAINER

[76] Inventors: Geoffrey R. Richter, 17 Binnea Street, Coolum Beach, Queensland, 4573; Frank M. Fisk, P.O. Box 115, Albany Creek, Queensland, 4035, both of Australia

[21] Appl. No.: 646,753

[22] PCT Filed: Aug. 18, 1989

[86] PCT No.: PCT/AU89/00354

§ 371 Date: Jan. 31, 1991

§ 102(e) Date: Jan. 31, 1991

[87] PCT Pub. No.: WO90/02084

PCT Pub. Date: Mar. 8, 1990

[30] Foreign Application Priority Data

Aug. 23, 1988 [AU] Australia ..... PI9983

[51] Int. Cl.[5] ..... B65D 7/26

[52] U.S. Cl. ..... 220/6; 220/1.5

[58] Field of Search ..... 220/6, 1.5, 4.28

[56] References Cited

U.S. PATENT DOCUMENTS

| | | | |
|---|---|---|---|
| 3,570,698 | 3/1971 | Dougherty | 220/1.5 |
| 3,602,388 | 8/1971 | Hurkamp | 220/6 X |
| 3,684,122 | 8/1972 | Bonomi | 220/1.5 |
| 4,088,238 | 5/1978 | Berwald et al. | 220/1.5 |
| 4,214,669 | 7/1980 | McQuiston | 220/6 |
| 4,360,115 | 11/1982 | Saunders | 220/1.5 |
| 4,577,772 | 3/1986 | Bigliardi | 220/6 X |
| 4,848,613 | 7/1989 | Yuan et al. | 220/1.5 |
| 4,858,779 | 8/1989 | Zimmerlund | 220/6 |

*Primary Examiner*—Steven M. Pollard

*Attorney, Agent, or Firm*—Renner, Otto, Boisselle & Sklar

[57] ABSTRACT

A collapsible box-type, water-proof shipping container comprising pivoting end walls and bifolding side walls. The end walls pivot inwardly of the container to lie on its base and the side walls fold longitudinally to lie on top of the end walls. The end walls and the side walls are completely enclosed within the base structure when collapsed, and the top wall completely seals the side and end walls from the exterior. The collapsed container takes up a volume approximately one quarter of that of the fully erected container and may be locked in its collapsed state. Provision is also made for locking to other containers above and below.

20 Claims, 16 Drawing Sheets

COLLAPSIBLE SHIPPING CONTAINER

FIELD OF THE INVENTION

This invention relates to containers for the transportation of cargo and bulk material and is particularly concerned with an improved form of collapsible container. The invention will be described with reference to shipping containers as these are the principal type of containers to which the invention has applicability, however it will be readily appreciated that containers for various uses on land or air may equally well incorporate such improvements; the reference to shipping containers merely being by way of exemplification and simplification of description.

DESCRIPTION OF THE PRIOR ART

The transportation of empty containers, as well as their handling and stowage, causes particular problems on board ships as well as on land, and this all adds significantly to overall freight costs. The handling and stowage of empty containers on ships can result in stability and safety complications, and congestions at cargo loading/unloading facilities on the wharf can be significantly increased thereby adding to the turn-around time for shipping. Costs are incurred in transportation whether by ship, land or air due to the same volume of space being taken up as for a full container, and the stowage of empty containers at a depot is no less expensive than the stowage of full containers.

It can be seen from all these factors that it is in the shipping industry's interest to have a container which, between the time of transportation of cargo or bulk material, can be reduced in volume and which can easily be handled in such a state. To this end, many forms of collapsible shipping containers have been proposed during recent years, and a selection of the most pertinent prior art is embodied in the following patent specifications: U.S. Pat. No. 3398850, U.S. Pat. No. 3529741, U.S. Pat. No. 3570698, U.S. Pat. No. 3765556, U.S. Pat. No. 3796342, U.S. Pat. No. 4177907, U.S. Pat. No. 4214669, U.S. Pat. No. 4388995, U.S. Pat. No. 4577772 and AU-A-68129/87.

There are, however, a number of problems with all these prior art containers and they therefore have not generally been endorsed by the shipping industry. One major problem is that the containers are not waterproof and the fittings are subject to high rates of rusting. Such rusting is particularly apparent when the containers are in a collapsed state since there is generally no external sealing of the interiors and hinges from the elements. Another major problem is that the inclusion of folding parts results in a considerably weakened structure and the containers do not adequately meet the rigid industry requirements. Furthermore, containers which appear at first instance to be quite satisfactory are found to be insufficient in withstanding the rough treatment that they are habitually subjected to and after a short time are worthless.

A still further problem with a number of the prior art containers is that they include a number of separable components which invariably are lost or damaged thereby giving rise to substantial inconvenience and delay.

OBJECTS OF THE INVENTION

It is an object of the invention to provide a collapsible container which obviates or at least minimises the aforementioned disadvantages.

It is a further object of the invention to provide a low cost collapsible container or, at least, one which falls within the cost structures of the majority of freight industry companies.

A still further object of the present invention is to provide a collapsible container which meets ISO freight container specifications.

Another object of the invention is to provide a collapsible container which has a rigid base construction which counteracts distortion and is of lightweight construction.

The foregoing and other objects of the invention will be fully understood from the following summary and detailed description of the invention.

SUMMARY OF THE INVENTION

According to the present invention, there is provided a collapsible box container having a base, two end walls, a top wall and two side walls; said base comprising a rigid reinforced rectangular structure with two opposing skirting walls and internal plinths at each corner terminating below the upper edges of the skirting walls, the said base including forklift tyne pockets extending through the opposing skirting walls; said end walls each comprising a rigid reinforced structure including integral side posts which form the load transmitting features of the erected container and which are supported by said plinths and locked thereto by keying elements located within the plinths, said side posts also including an inner facing pivoting arrangement to permit pivoting of the end walls inwardly of the container; said top wall comprising a rectangular reinforced structure including forklift tyne pockets and a fixing block at each corner; said side walls each comprising two rigid reinforced rectangular structures longitudinally hingedly connected to one another and also hingedly connected to the inner edge of an adjacent skirting wall and a reinforced longitudinal edge of the top wall; whereby the container is collapsible by fractionally raising the top wall, unlocking the side posts from the plinths, pivoting each end wall inwardly of the container so that it assumes a horizontal position between the skirting walls, lowering the top wall while simultaneously collapsing the side walls inwardly of the container so that each side wall folds into two face-to-face sections lying within the skirting wall and so that the adjacent perimeter of the top wall is substantially coplanar with the outer sides of the skirting walls.

Although the base is defined as including only two opposing skirting walls, in practice it will generally have three such walls as this extra wall will substantially add to the strength characteristics of the base. Two skirting walls will usually only be present if it is desirable for the container to have a doorway at each end instead of the normal situation where a doorway is provided in one end of the container only. It is, however, not out of the question for there to be a fourth wall so that the entire perimeter of the base is skirted. Such a construction is, nevertheless, not particularly convenient as a customs inspection section must often be provided so that the interior of the container can be viewed, and the provision of a removable viewing panel in place of the fourth wall is an ideal location for such an inspection section. The removable viewing panel can be stowed in a slotted recess directly below the container when the container is to be collapsed.

Another advantage of not having a skirting wall at one or both of the ends of the container, is that it enables easy access to the container for loading or unloading purposes. Clearly any such wall would impede the passage of wheeled loading vehicles into and out-of the container or, in fact, most manually performed loading and unloading.

The skirting walls may be fabricated from flat metal plate and welded to the outer edges of the reinforcing base structure. A J-angle extrusion is suitably welded to the upper edge of the skirting walls to provide a groove for the top wall to rest within when the container is in a collapsed state. This J-angle extrusion may be braced with angle bracing extending from the reinforcing base structure and may include a resiliently deformable sealing strip of rubber or like material on upper-facing surface to prevent ingress of water into the collapsed container.

The provision of the skirting walls is a very important feature of the invention as the distribution of load onto these walls allows for minimal longitudinal distortion of the container base, which is a problem with the prior art constructions. Such distortion is practically eliminated when a third skirting wall connects the opposed skirting walls.

Preferably, the base is fabricated from cast metal section and pressed metal panels. The perimeter of the base is ideally of box beam construction wherein each box beam is welded to a corner plinth at each end. Tyne locating pockets of larger rectangular box beam section intersect the perimeter box beams at conventional spacings, symmetrical with the mid-point of the longitudinal edges of the base. One or more additional reinforcing metal sections may extend between the shortest sides of the base for additional strength.

The spaces between the various metal reinforcing sections preferably accommodate pressed metal panels which are welded to the reinforcing sections. The number of pressed metal panels will therefore generally be the same as the number of openings to be covered. Thus, for instance, if there are three openings defined by a rectangular framework traversed by two tyne locating pockets, then there will generally be three pressed metal panels. A further longitudinal mid-sectional reinforcing member will call for six pressed metal panels, and so forth. However, it is also envisaged that fewer pressed metal panels than the number of openings could equally well be employed, with one or more of such panels covering more than one of the openings. Consequently, a single pressed metal panel could be used or, indeed, any number of panels.

The pressed metal panels are suitably fabricated from sheet steel and are welded to the reinforcing members and the tyne locating pockets so as to form a strong waterproof structure. The profile of the pressed metal panels will be such as to add maximum rigidity to the base and to this end may include parallel or cross-ribbed pressings formed in the surfaces thereof. A particularly preferred profile is a cross-profiled pressing wherein the arms of each cross extend between the corners of adjacent reinforcing members.

It is also envisaged that the reinforced base structure have one or more plane sheet metal panels welded to it instead of a profiled section. Such a plane sheet panel may include strengthening ribs welded to its lower surface in a suitable array to provide maximum strength characteristics, bearing in mind the intended end use for the container.

The metal panels in the base may be covered by conventional marine ply or slatted decking to provide a finished surface on which the cargo may be stowed.

The plinths located in each corner of the base structure are preferably hollow metal castings which incorporate in their lower sections a standard fitting for connecting shipping containers together, and in their upper sections a pin housing. The pin housing includes a flat upwardly facing surface on which a corner post of an end wall rests when the container is in an erected condition. The flat upwardly facing surface has an opening through which an engaging peg may be extended from the interior of the upper section of the plinth, to engage with an appropriate retainer in a cavity formed in the base of a corner post, when the engaging peg is rotated. Rotation of the engaging peg is enabled by a sliding lever which projects a short distance from a curved slotted groove in an outwardly facing side wall of the upper plinth section. The main function of the engaging peg is to prevent lateral movement of the corner post.

In order to enable the end walls to pivot off their associated plinths, suitable hinge rings or the like are welded adjacent to the inwardly pivoting sides of the posts. Preferably, two hinge rings are welded at the upper intersection of an outer reinforcing base member and the bottom of the upper section of the plinth.

The bottom most portions of the lower sections of the plinths are arranged to extend a short distance below the reinforcing members defining the perimeter of the container in order to ensure that the container is raised from the support surface on which it rests.

When the base has fewer than four fixed skirting walls, the removable walls which are required to make up the number of walls to four may be accommodated in grooved channels formed by a J-profile or like edging welded to the vertical facing sides of opposing plinths. This construction permits the sliding panel or panels to be readily placed in a vertical location between the opposing fixed skirting walls when the container is collapsed to ensure sealing of the interior from the elements. Surety of sealing may be guaranteed by appropriate placement of rubber strips in the support edging. The sliding panel or panels may be stored beneath the container when the container is erected, in similar grooved channels formed by metal profile extending along the bottom surfaces of opposite edge-defining reinforcing members.

Apart from providing a simple base for the container and a water-tight compartment for all wall components, the base structure is designed so as to transfer the load on the floor to the outer reinforced edge and thereby reduce stress and deformation. The metal panels are suitably formed in such a manner as to carry maximum load for the minimum material weight by taking advantage of metal pressing techniques employed in the automotive industry.

The end walls each comprise a rigid reinforced structure including integral side posts of box iron construction which form the corner posts of the erected container and act as load transmitting points when containers are stacked one on top of another. The side posts include an inner facing pivoting arrangement located on the lowermost section to permit pivoting of the end walls inwardly of the container. This pivoting arrangement may take the form of an angle-iron profile extending from the base of each post wherein the faces of the profile are co-planar with the adjacent sides of the post. A reinforcing spacing bar will suitably extend between such angle-iron profiles on the same end wall at the bottom thereof.

The inwardly facing surface of the angle-iron profile, that is, the surface which is directed towards the opposite end of the container, is provided with a lug or lugs for alignment between or about the hinge rings formed in the container base. A cylindrical passageway in each lug permits alignment with the hinge rings through which a pivot pin is inserted.

Other conventional pivoting arrangements may equally well be used however it has been found that the above described arrangement is particularly rigid and is not affected by the harsh treatment that shipping containers are put to.

The top reinforcing member of the end wall is conveniently of box-iron construction and extends between the side posts, above their uppermost heights, that is, it does not extend to the outer side edges of the posts. The reason for this is to enable the top wall corner fixing blocks to be firmly accommodated and retained on the top of the posts in the manner to be hereinafter described. Right angle joining plates may conveniently be welded to the inner upper corner of the side walls to provide additional strengthening as well as to ensure adequate sealing. The inner facing surfaces of such plates also provide suitable locations for the placement of rubber pads to cushion the end walls when they are lowered into the base.

Accommodating lugs are preferably formed on the outwardly facing sides of the corner posts, that is, the sides containing the outer planes of the end walls, for the purpose of providing attachment means for the side walls, as is also described hereinafter.

The faces of the end walls will be constructed according to whether they are intended to function as doorways for loading and unloading the container or whether they are intended as fixed walls. Obviously there must be at least one doorway and both fixed and doorway constructions will therefore be described.

A fixed wall construction will preferably include suitable bracing members extending between opposite posts, most preferably in a diagonal fashion. Such bracing members may be flat steel strip, angle iron or the like, which is welded to each post. Pressed metal panelling may then be welded to the exterior facing side of the wall to provide a totally sealed construction. If necessary, a customs inspection section which incorporates a removable panel arranged as previously described in connection with the base, may be incorporated in the lowermost portion of the end wall.

A doorway arrangement in the endwall may assume any one of a number of conventional constructions. One preferred construction comprises two outwardly opening doors which take up the entire endwall opening between the side posts and an upper lintel and a lower step. Each door is suitably hinged along a vertical edge to an adjacent post and can be locked to the lintel and the step by conventional push-bar locks.

The top wall comprises a rectangular reinforced structure which includes forklift tyne pockets and a fixing block at each corner. Each fixing block is adapted for accommodating in the recess formed between the top of a corner post in an end wall and the adjacent horizontal lintel or reinforcing member in the top of the end wall. The fixing block will generally comprise a hollow housing with openings to enable securement by conventional locking means contained therein to the base of another container. In addition, an opening in the inwardly facing side of the fixing block enables alignment with a lug projecting into the aforementioned recess from the corner post.

In one embodiment, the fixing blocks include a lower depending section which has one or more openings and which is adapted for accommodation within the confines of the associated plinth. Alignment of the opening or openings in the depending section with matching openings in the wall of the plinth enable a key or pin to be inserted to thereby lock the top wall to the plinth when the container has been collapsed.

The perimeter of the top wall is preferably formed from angle iron so it can snugly fit over the side and end walls. For additional securement, recesses may be formed in the depending edge of the angle iron perimeter, which co-act with lugs formed in the adjacent top reinforcing member of the end walls. Alternatively, J-angle steel edging is welded to the lower depending perimeter of the top wall to provide the requisite seal with the side walls of the erected container and the base structure when collapsed. This edging may include a resiliently deformable elastomeric strip to aid in weatherproofing.

The forklift tyne pockets are preferably box section steel of the same type as in the base, which are welded between the angle iron perimeters in a similar symmetrical arrangement to those in the base. This provides a very rigid, lightweight structure, however additional reinforcing members may be welded in place if extra strength is required for any particular purpose.

The top wall is preferably finished with pressed metal sections which are welded between the reinforcing members to provide a weather-tight seal. The profile of the metal sections will be chosen so as to produce the greatest strength characteristics and may, for instance, comprise a plurality of parallel corrugations.

Each side wall comprises two rigid reinforced rectangular structures which are longitudinally hinged to each other. The free longitudinal edges are hinged respectively to the inner edge of an adjacent skirting wall and to the longitudinal edge of the top wall. The two rectangular structures which constitute each side wall are preferably identical to one another which, in effect, means that each componentry structure in the container is interchangeable with another. Such identity of structure clearly means reduced costs in building the container and low cost repair should one of the componentry structures become damaged and need replacement.

The rectangular wall structures are hinged to enable a bifolding action so that upon folding, the upper wall structure folds down and lies over the lower wall structure within the confines of the base of the container. Hinges capable of enabling such an action are well known. One preferred form of hinge comprises a three part construction. The one part comprises an eyed flange with cut-outs on one longitudinal edge of the upper wall structure. A similar eyed flange is formed on the upper longitudinal edge of the lower structure, and the third part comprises a metal connector piece having tubular openings which align with the cut-outs in the eyed flanges. Hinge pins are inserted into the eyed flanges and connect each wall structure to the metal connector piece.

The hinges connecting the wall structures to the top wall and skirting wall are also of conventional design.

Ideally, the pins employed are non-corroding to reduce maintenance.

The rectangular wall structures are preferably fabricated from flat plate steel members which outline their peripheries, and which are interconnected with an appropriate number of flat metal braces. Suitably, such braces extend from the region where the hinges are located to give extra strength to the sidewall sections were it is most needed and where most stress is likely to occur during collapsing and erecting the container.

Angle iron members are preferably welded to each end of each rectangular wall structure for the purpose of overlapping the corner posts and being retained thereagainst. One method of ensuring such retention is to provide openings in the overlapping angle iron members which fit over nubs formed down the edge of the corner posts. The nubs may comprise part of a wedging locking system to enable positive locking and also to enable the compression of the corner post and sidewall together to form a waterproof seal. Ideally, the wedging consists of a sliding action to ensure fast convenient locking and added strength for any additional lifting or movement of the corner section.

The angle iron members enable the container to be weatherproofed. If necessary, a rubber gasket is located in the corner section to ensure such weathertightness and also for the purpose of acting as a shock absorber for any movement of the wall.

The side walls are completed by pressed steel panels welded between the opposing longitudinal flat plate steel members. These panels may be suitably profiled if necessary to provide added strength to the structure.

Preferably, a sealing flap is provided on the inner side of each side wall which overlaps the longitudinal hinging region between the componentry structures. Depending on the material from which the sealing flap is fabricated, it may, if suitably rigid, also act as a wall strengthening member or base. The functions of the sealing flap are thus primarily to keep water or other foreign objects from entering the container while acting to provide some additional strengthening to the wall section. Such a flap is therefore ideally fabricated from pressed metal and is profiled to snugly fit over the hinging region when the side walls are erected. To this end, the lower longitudinal edge of the sealing flap may be permanently fixed to the upper region of the lower side wall structure and may be retained firmly against the lower region of the upper side wall structure by suitable clip means or the like. This construction mitigates any possibility of distortion of the side walls caused by the shifting of loads within the container, and also permits the side wall structures to fold back-to-back without stressing the hinges of the wall.

Another feature of the sealing flap is that it ensures the side wall is maintained upright during erection of the container by the said clip means being located at arm's reach within the container close to the ends. This also acts as a safety feature as it is not necessary to enter the container when it is in a semi-erected state.

In order to collapse a container constructed in accordance with the preceding description, the top wall is fractionally raised by inserting the tynes of a forklift into the forklift tyne pockets therein. This action unseats the top wall from the corner posts enabling each end wall to be lowered inwardly of the container after unlocking the base of the posts from their plinths and disengaging the front and rear wedging arrangement. The clip means which retain the sealing flaps are then undone and the top wall is lowered toward the base until it rests on the skirting wall. The front container viewing panel is removed from its housing below the container and inserted into its vertical housing and the plinths are locked to the corner fixing blocks in the top wall. The container is now completely collapsed and may be stacked onto another container and locked thereto by the keying mechanism in the corner fixing block of the other container and the base of the plinth in the container being stacked. In this manner, a pile of containers may be stacked together.

Unstacking and erection of the containers may be carried out in a reverse sequence of steps.

The total time required to erect or collapse a container employing two people and one machine is approximately five minutes.

The structure of the container is such that when erected it is structurally capable of being used in a manner similar to a rigid non-collapsing type container without any special lifting, loading or transportation techniques required.

The container may be designed to collapse within a space one quarter of the erected container height and volume, thereby providing an extremely economical unit for storage or re-transportation to a cargo pick-up area.

BRIEF DESCRIPTION OF THE DRAWINGS

Preferred embodiments of the invention will now be described with reference to the accompanying drawings, in which.

DESCRIPTION OF THE PREFERRED EMBODIMENTS

Figure 1:
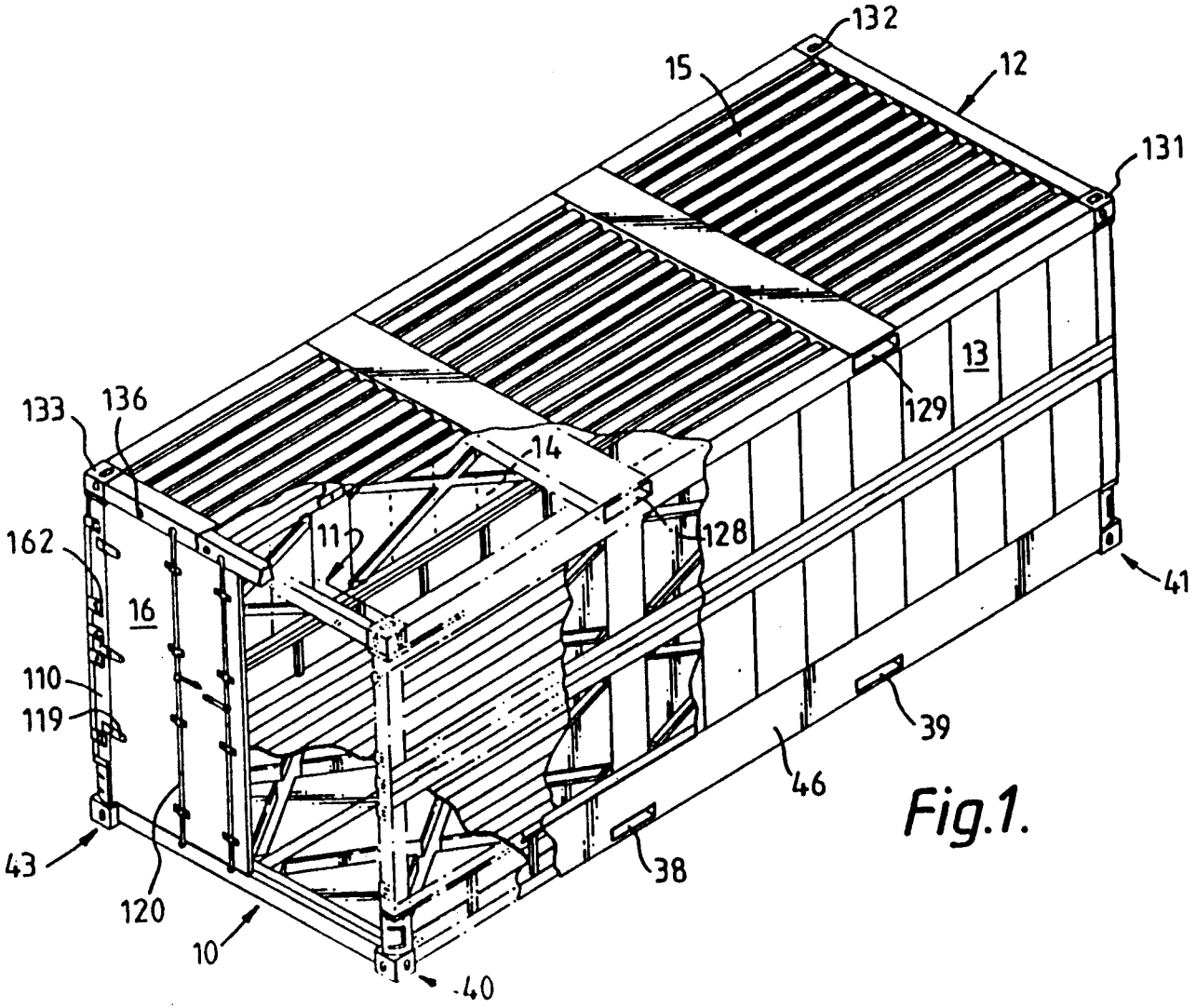
FIG. 1 is a perspective view of collapsible container according to the present invention, in an erected state with a cut-away section to reveal some of the internal structure.

In all the drawings, like items are referenced by the same numerals. Referring firstly to FIG. 1, the collapsible container comprises a base 10, end walls 11, 12, side walls 13, 14 and a top wall 15. The container illustrated in this and subsequent drawings has a doorway 16 in the end wall 11 and is closed at endwall 12 (e.g. see FIG. 2).

Figure 2:
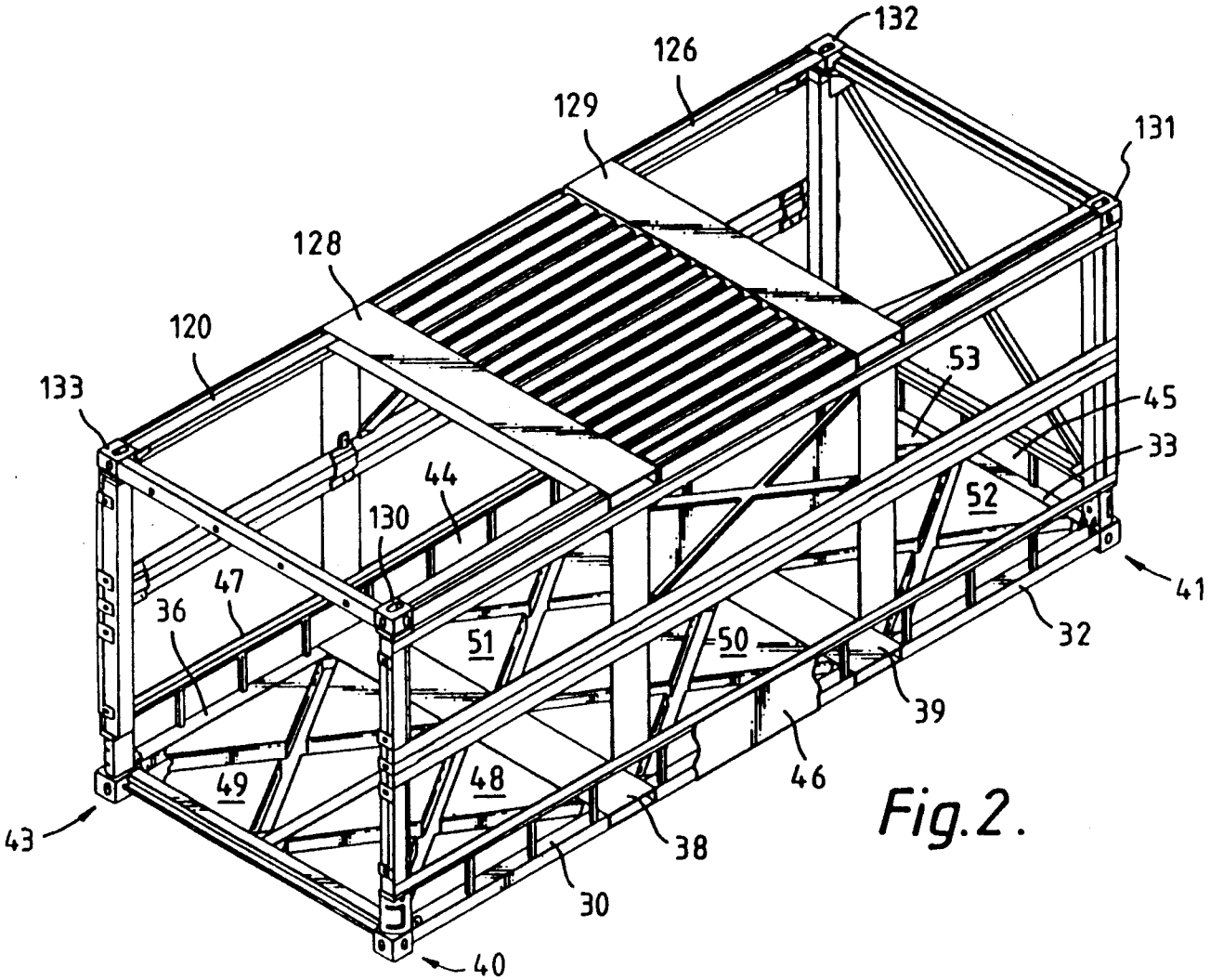
FIG. 2 is a perspective view of the container of FIG. 1 with all wall panelling removed except for a section of the top wall and side wall.

The container is fabricated from a plurality of rigid reinforcing members as illustrated in FIG. 2. These are described in detail in subsequent drawings.

Figure 3:
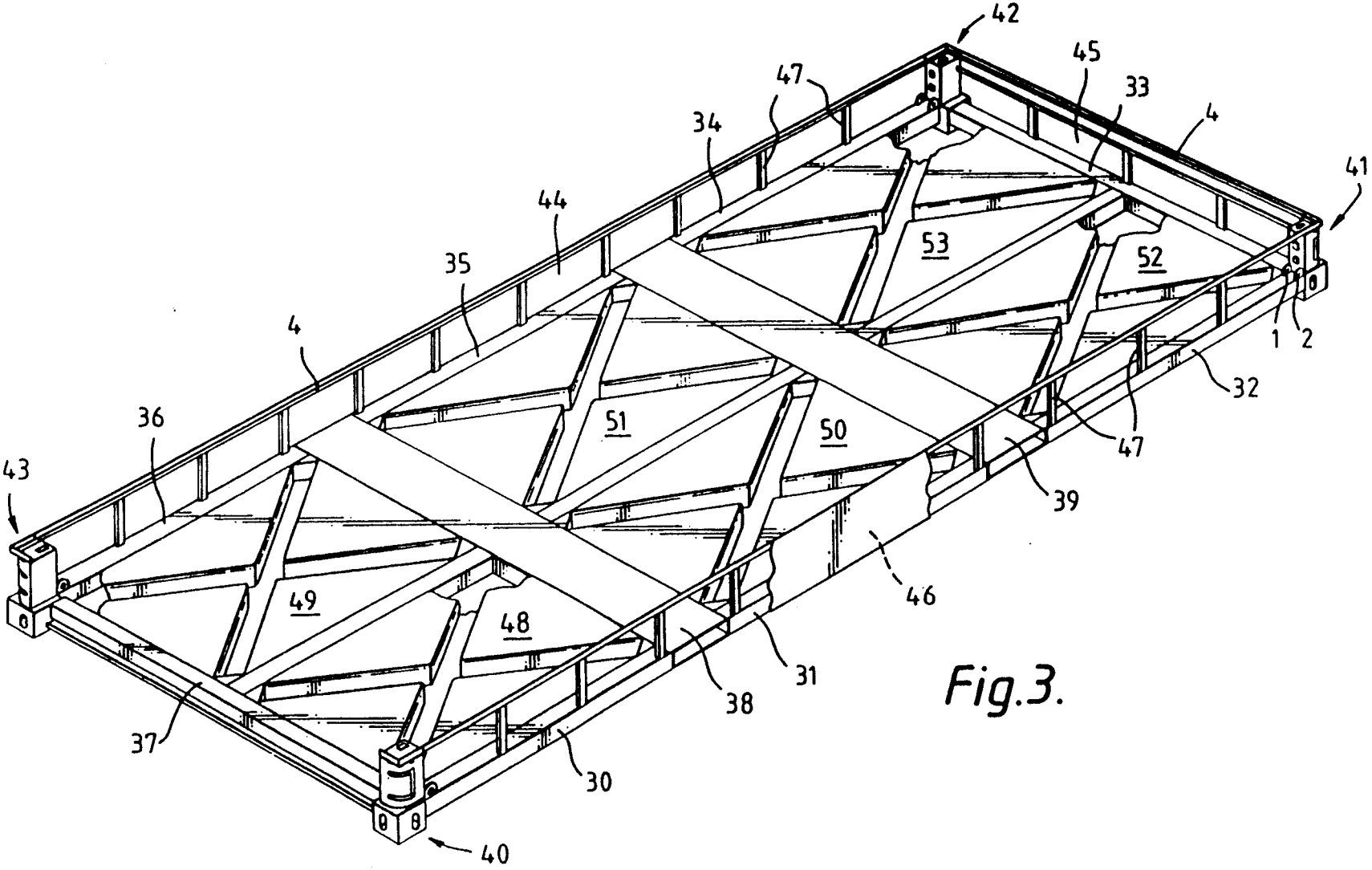
FIG. 3 is a perspective view of the base of the container of FIG. 1.

Referring specifically to FIG. 3 but also to FIG. 2, the base comprises a rectangle defined by eight box steel members 30, 31, 32, 33, 34, 35, 36, 37; two tyne locating pockets 38, 39; and four corner plinths 40, 41, 42, 43. These elements are all welded together in a rigid structure. Extending upwardly from three sides are skirting walls 44, 45, 46. (the near one, 46, being indicated by a dotted lead line as only a small section has been illustrated so that the underlying structure can be clearly seen). The upper edge of the skirting wall has a J-channel iron section 4 welded to it and this section is lined on its inwardly facing surface with a rubber seal. The J-channel section is additionally supported by a plurality of equally spaced braces 47 extending upwardly from the box steel members. The space between the reinforcing members is accommodated by pressed steel plates 48, 49, 50, 51, 52, 53 to provide further strength to the structure.

Figure 4:
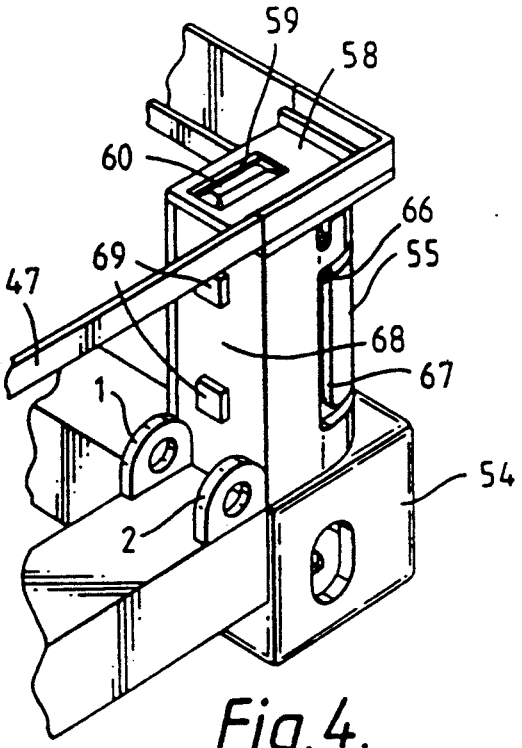
FIG. 4 is a close-up view of a corner section of the base of FIG. 3.
Figure 5:
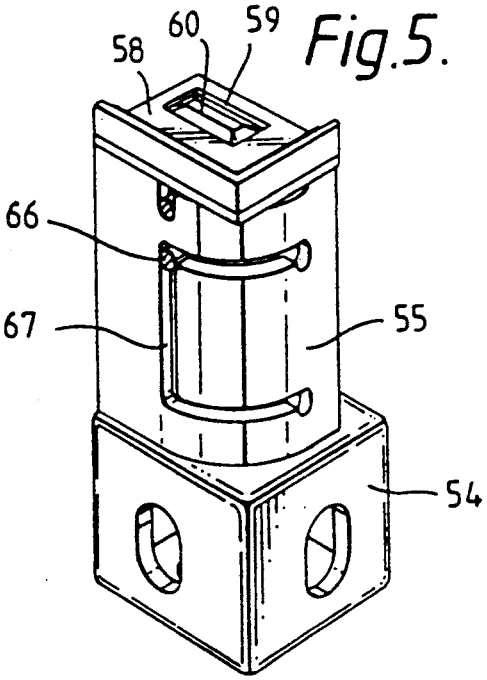
FIG. 5 is an end-on perspective view of the plinth shown in FIG. 4.
Figure 6:
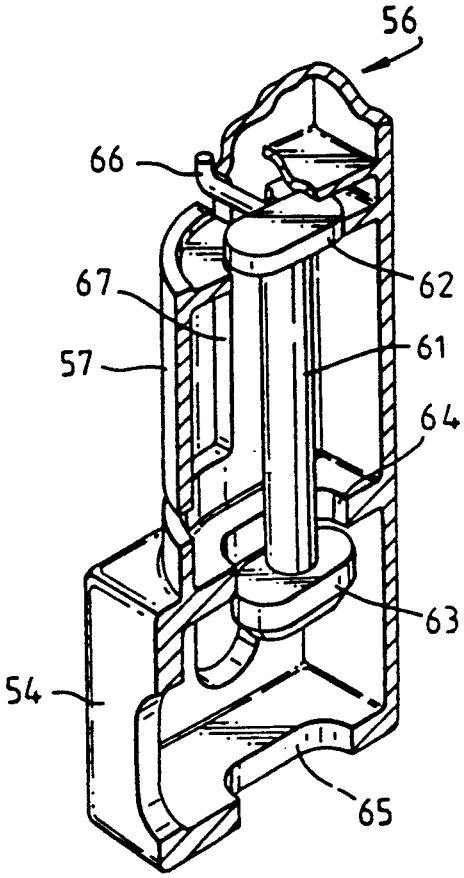
FIG. 6 is a perspective cut-away of the corner section of FIG. 5A.

The corner plinths 40, 41, 42, 43 are illustrated in more detail in FIGS. 4, 5, and 6, to which reference is now primarily made. Each plinth comprises a hollow metal casting including a cubical casing 54 in its lower portion and a semi-cylindrical housing 55 in its upper portion. The cubical casings raise the base of the container from its resting surface as can be seen in FIG. 4.

The semi-cylindrical housing 55 has an upper chamber 56 (see FIGS. 28 and 29) and a lower chamber 57. The upper chamber includes a substantially flat outer surface 58 on which a corner post of the container is adapted to bear when the container is erected, and an opening 59 for a locking pin 60 of an adjacent top wall fixing block to extend therethrough for locking purposes (to be hereinafter described in more detail). The lower chamber 57 accommodates a securing pin 61 which extends into the cubical casing 54. The securing pin has enlarged heads 62, 63 on opposite ends which may be manipulated through correspondingly shaped openings 64, 65 in the cubical casing and interlocked with a container upon which it rests by rotation of the pin 61 about its axis. Manipulation and rotation of the pin 61 is effected by means of a lever 66 which is connected to the head 62 of the pin and projects from the semi-cylindrical housing by way of a slotted groove 67. A sleeve is also provided within the semi-cylindrical housing for the purpose of guiding the pin between its two locations and to prevent lateral movement. Such sleeves have been omitted from the drawings to avoid confusion in the illustrations.

The inner facing edge 68 of the plinth includes numbs 69 to assist the rigid securement of the corner post to the plinth as hereinafter described, and hinge rings 1 and 2, are welded at the base of the semi-cylindrical housing for the door hinging mechanism.

Figure 7:
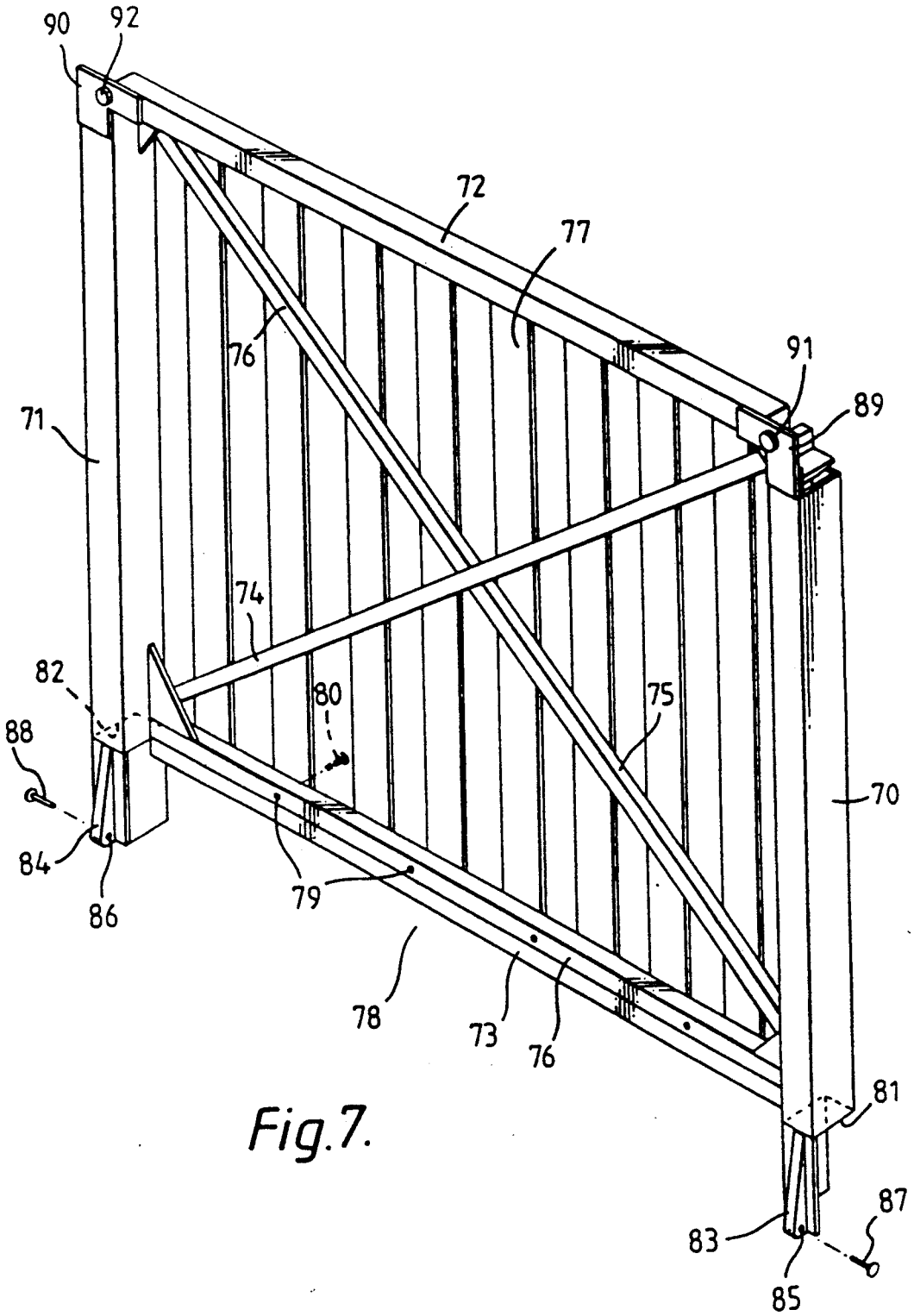
FIG. 7 is a perspective view of a closed end wall of the container of FIG. 1.

Referring to FIG. 7, the endwall comprises two posts 70, 71 of box steel separated by a top reinforcing member 72 of box steel and a bottom bar 73. Reinforcing struts 74, 75, 76 of flat iron strengthen the endwall from distortion and a pressed steel panel 77 of vertically ribbed profile, is welded over the surface except for the bottom region 78 which is open as this is located within the end skirting wall 45 (see FIG. 3). Threaded holes 79 are provided for in reinforcing strut 76 for the purpose of connecting the endwall hard against the end skirting wall by means of bolts 80 but these are not generally required as frictional contact is usually sufficient.

The posts 70, 71 are adapted to rest on the adjacent plinths in the base on flat surfaces 81, 82 when the endwall is erected.

Wedge shaped blocks 83, 84 permit pivoting of the endwall inwardly of the container. These wedge blocks are formed on an extension of the posts 70, 71 and are adapted to extend down the inner side of each associated plinth. The extensions on which the wedge blocks are formed are right angle steel sections. Openings 85, 86 accommodate hinge pins 87, 88 which enable the wedge blocks to be hingedly connected between the hinge rings 1,2 in the base.

Corner strengthening and sealing plates 89, 90 are welded to the top corners of the endwall and rubber pads 91, 92 are fixed thereto for the purpose of cushioning the endwall when it is lowered into the base.

Figure 8:
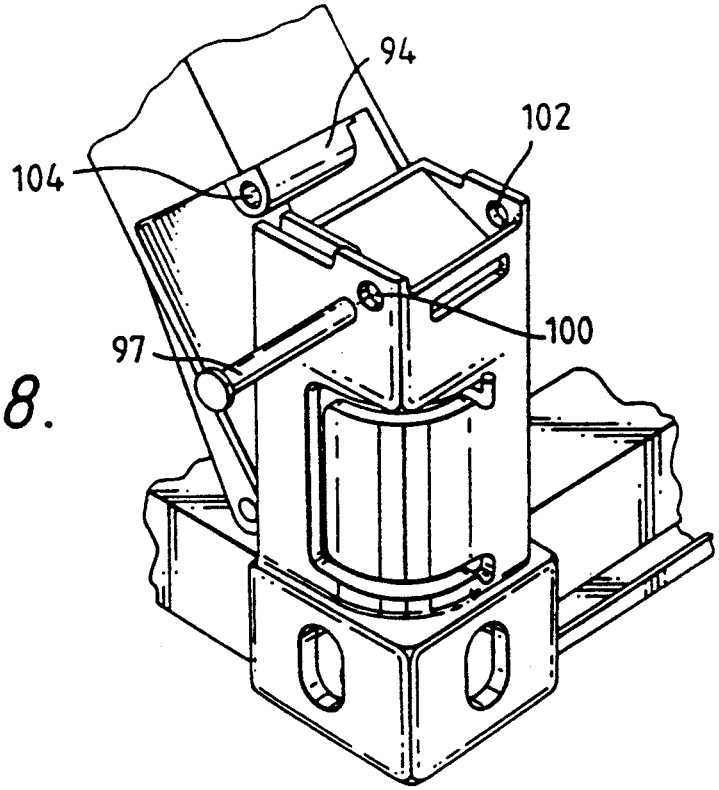
FIG. 8 is a close-up perspective view of another pivoting system which may be incorporated in the present invention.
Figure 9:
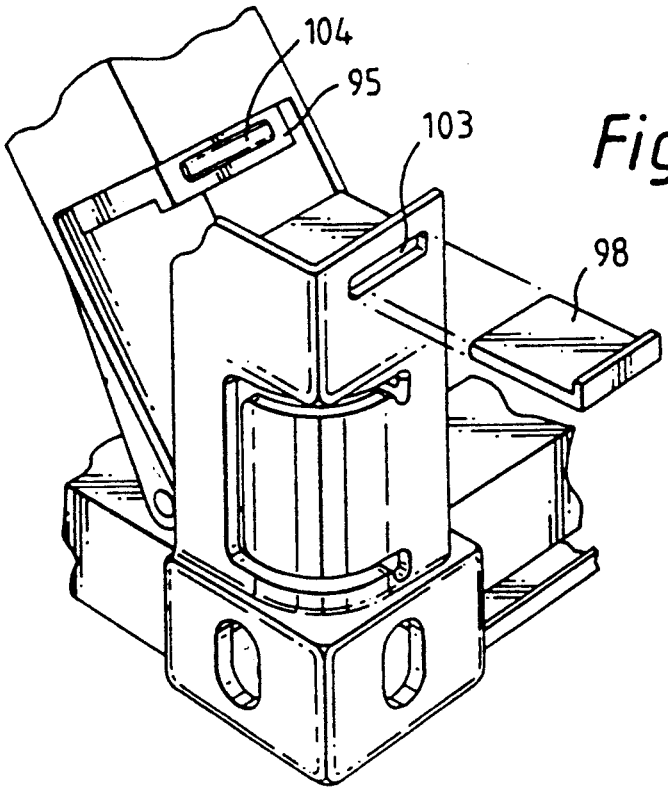
FIG. 9 is a close-up perspective view of a further pivoting system which may be incorporated in the present invention.
Figure 10:
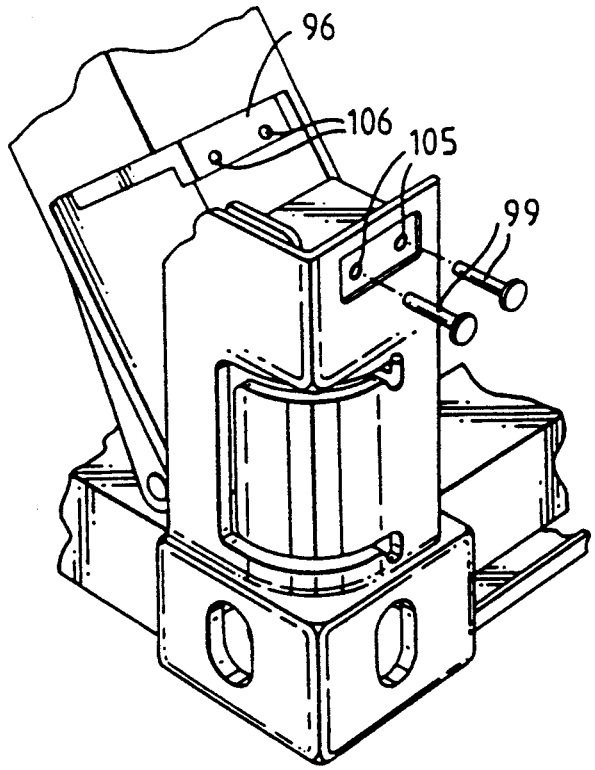
FIG. 10 is a close-up perspective view of a still further pivoting system which may be incorporated in the present invention.

In order to provide a more positive locking of the posts 70, 71 to their plinths, the alternative locking mechanisms illustrated in FIGS. 8, 9 or 10 may be employed. These mechanisms include a tongue member 94, 95, 96 formed as an extension of the flat surfaces 81, 82 of the posts, which engage in complementary shaped recesses in the top of the plinths. Upon engagement, such tongue members are locked to the plinths by pins 97, 98, 99 which pass through aligned openings 100, 101, 102; 103, 104; 105, 106 in the walls of the plinths and in the tongue members.

Figure 11:
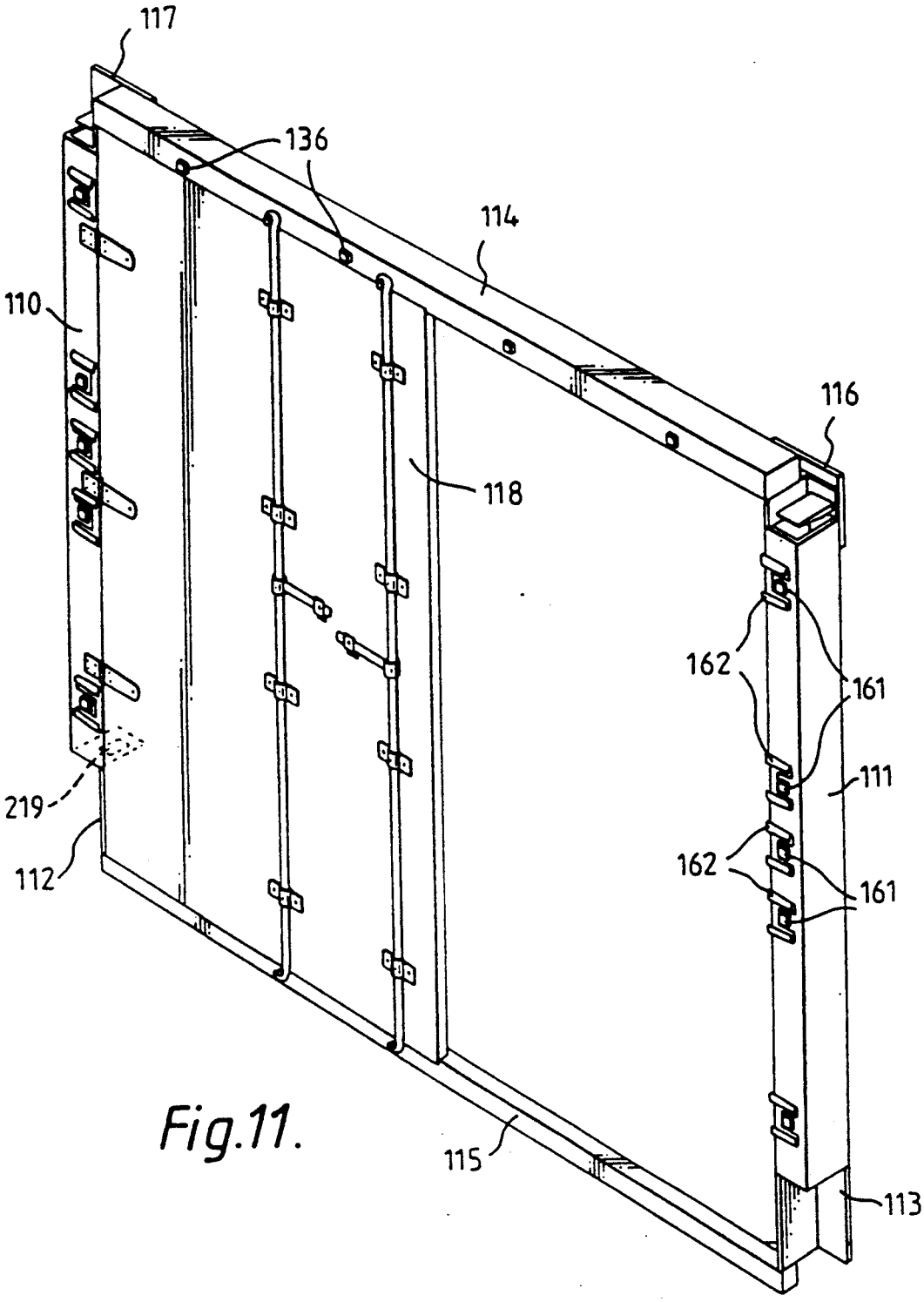
FIG. 11 is a perspective view of the door end wall of the container of FIG. 1, showing one door in position.

Referring to FIG. 11, the end wall containing the doorway comprises two upright posts 110, 111 of box section with lower extending angle sections 112, 113. The rear lower angle sections also include wedge shaped pivots similar to the closed end wall. A lintel 114 of box section and a step 115 also of box section extend between the posts to provide a rigid structure. The structure includes right angular bracing plates 116, 117.

Figure 12:
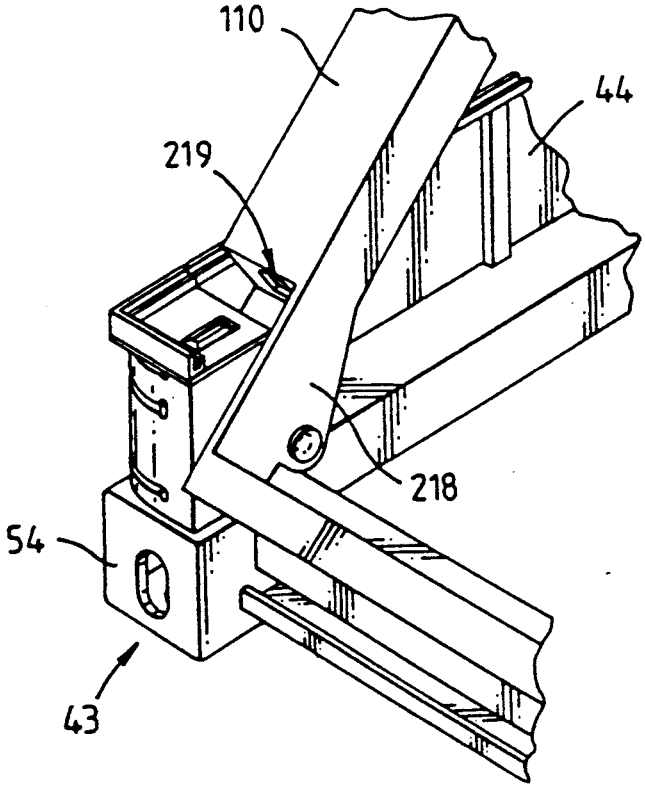
FIG. 12 is a perspective end view of the door end of the container base illustrating a pivoting arrangement for the container of FIG. 1.

The pivoting arrangement for this end wall is substantially the same as for the rear closed wall, however the arrangement for achieving this is slightly modified as shown in FIG. 12. Here the wedge shaped pivots (e.g. see item 218) are formed as flanges in the extension of the post side walls. Additionally, an opening 219 is formed in the base of each post so that the locking pin in the plinth can be inserted therein to provide additional rigidity.

Reverting back to FIG. 11, the door comprises a rectangular metal panel 118 hinged to each post 110 and 111 (the later not being illustrated as it is the same) by conventional hinges 119 (only one of which is shown). A pull-bar locking system locks the door to the lintel 114 and step 115.

Figure 15:
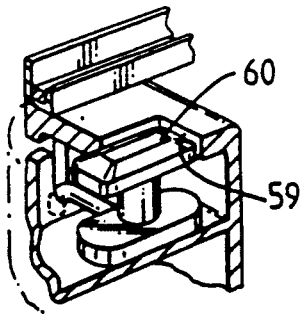
FIG. 15 is a perspective cutaway view of a corner of FIG. 14.
Figure 13:
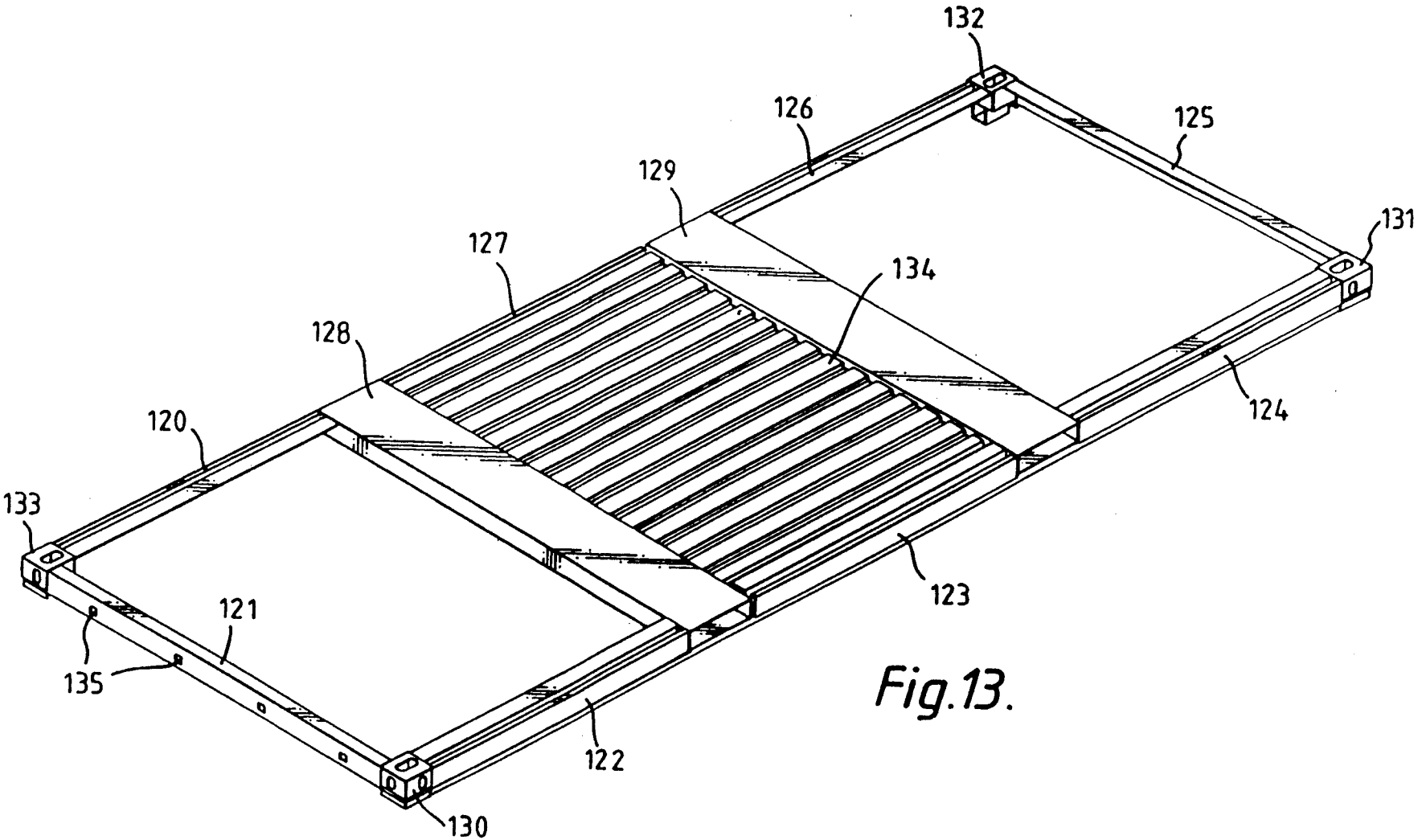
FIG. 13 is a perspective view of the top wall of the container of FIG. 1, with two metal panels omitted for clarity of corner detail.
Figure 16:
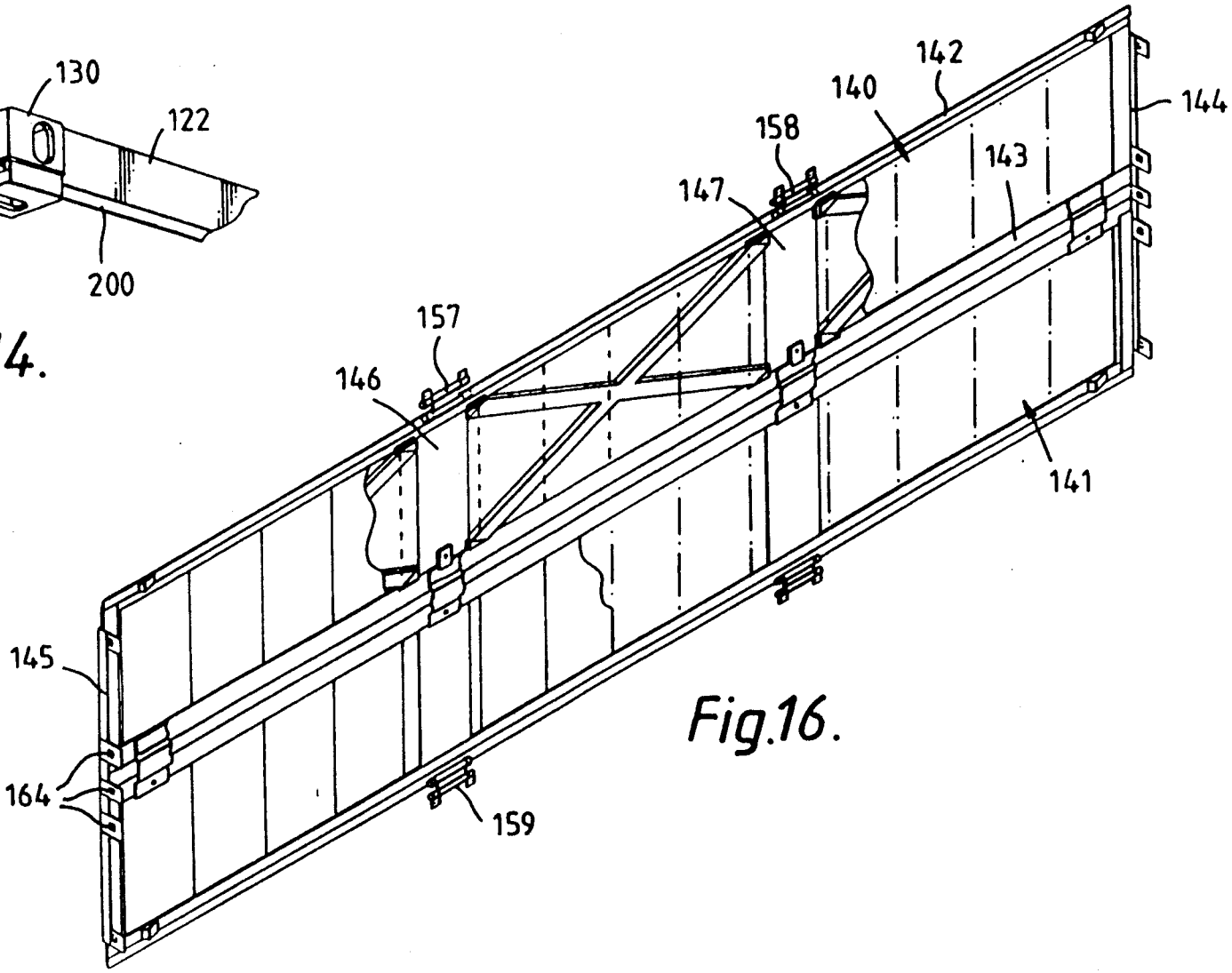
FIG. 16 is a perspective view of a side wall of FIG. 1 viewed from the inside.
Figure 14:
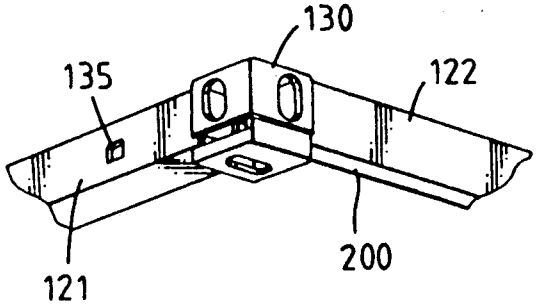
FIG. 14 is a perspective view of a corner of the top wall of FIG. 13, viewed from below.
Figure 17:
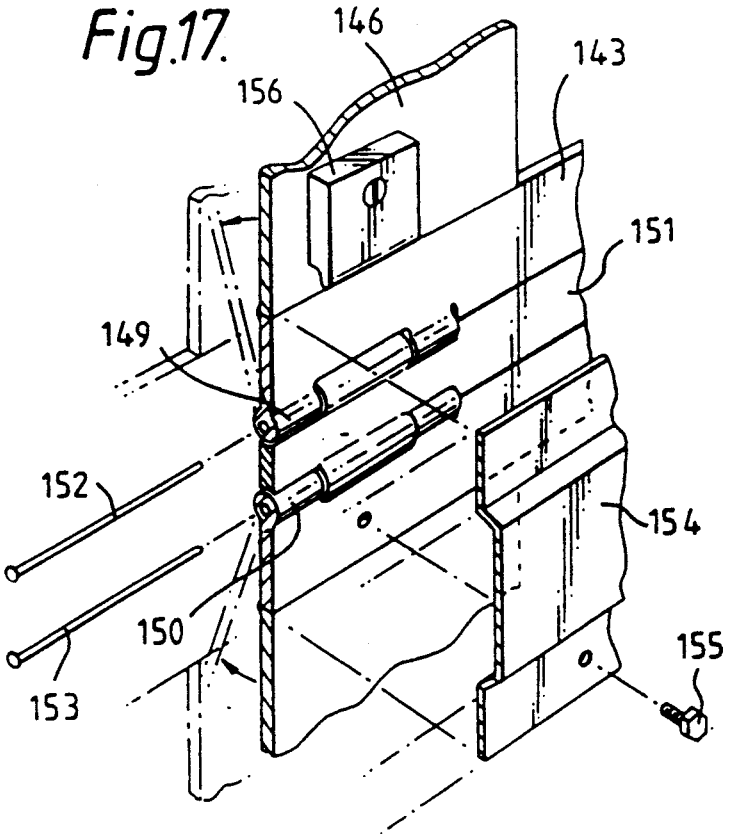
FIG. 17 is a partial exploded perspective enlarged view of the side wall of FIG. 16.

FIG. 13 illustrates the top wall of the container. This comprises eight lengths of angle iron 120, 121, 122, 123, 124, 125, 126, 127 welded together with two box iron tyne pockets 128, 129 and four fixing blocks 130, 131, 132, 133 to form a rigid rectangular structure. The spaces between the reinforcing members are filled in with pressed metal panels, one of which, viz 134, is illustrated. These panels are welded in place to ensure an internal waterproof and distortion resisting structure. The periphery of the top wall includes a J-channel iron section 200 welded to its periphery and lined on its inwardly facing surface with a rubber seal 201 (see FIGS. 14, 28, 29). The corner blocks are cast steel hollow housings which are adapted for locking to the plinths when the container is collapsed as well as to another container when placed on top of it. One of these is illustrated in more detail in FIG. 14 and, internally, in FIG. 15.

Openings 135 are provided along the front and rear edges of the top wall for the purpose of inter-locking with lugs 136 formed on the adjacent lintel 114 and top reinforcing member 72 of the end walls.

Reference will now be made to FIGS. 16, 17, 18 and 19 which show the side walls and their hinging arrangements.

Each side wall comprises two rigid rectangular structures 140, 141 hinged longitudinally together. The structures are formed from flat metal strip 142, 143 connected by end angle iron member 144, 145 and metal braces 146, 147. Infills are provided by profile metal sheeting 148 as shown clearly in FIG. 19.

The jointing hinge between the side wall structures comprises eyed flanges 149, 150 on adjoining edges and an eyed metal connector piece 151 hingedly connected to each flange by means of pins 152, 153.

Figure 18:
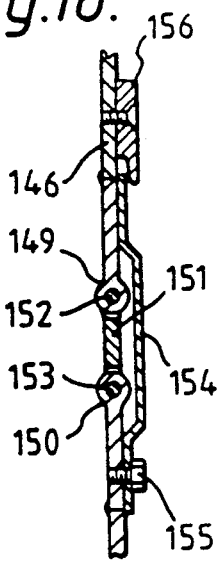
FIG. 18 is an end view of the hinge illustrated in FIG. 17.
Figure 19:
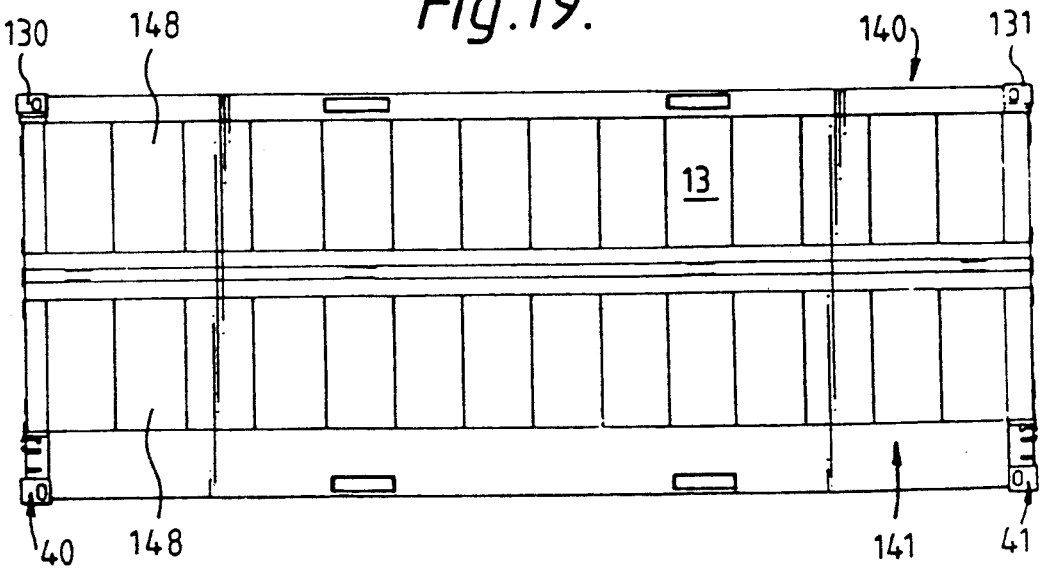
FIG. 19 is an external side view of the container of FIG. 1.

A sealing flap 154 of metal profile, is connected by means of bolts 155 to the eyed flange 150 so that it will push hard against the hinge joint when the wall is erected as shown in FIG. 18. A catch 156 enables securement of the sealing flap to the flange 149. The catch may be manually rotated in order to release the sealing flap when the sidewall is to be collapsed.

Hinges 157, 158 connect the side wall to the inner edge of the top wall to the inner edge of the skirting wall in the base.

Figure 21:
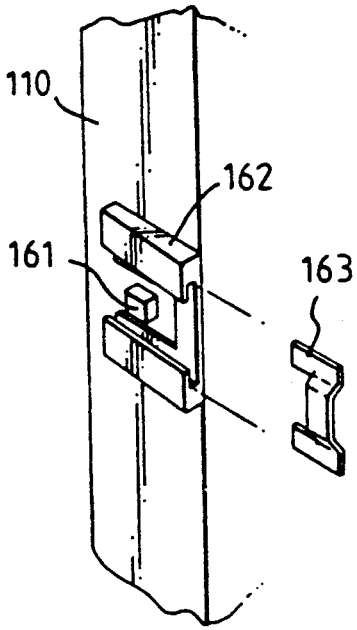
FIG. 21 is an enlarged perspective view of a wedge/-peg lock shown in FIG. 12.
Figure 22:
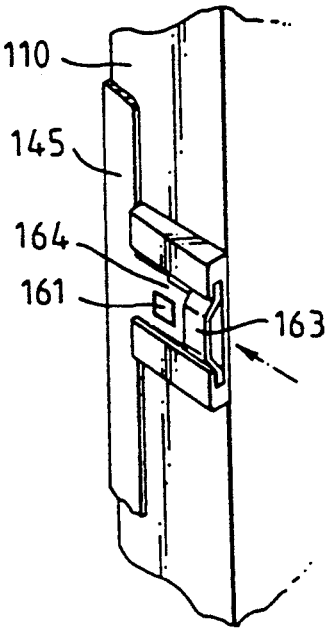
FIG. 22 is a further enlarged perspective view of the arrangement of FIG. 21 showing an engaged state.

The angle iron members 144, 145 are for the purpose of wrapping around the end walls and connecting to a wedge/peg interlocking system as illustrated in FIGS. 21 and 22 to which references will now be made. This system comprises a plurality of pegs 116 located down the front faces of each post (e.g. see FIG. 11). The pegs each have a surrounding rectangular wedge-retaining slotted housing 162 and associated clamping member 163 (shown in exploded view in FIG. 11 but which, in fact, is retained permanently in the slotted housing). The construction is such that eyed wings 164 on the angle iron members 144, 145 fit between the sides of the wedge-retaining slotting housings, and over the pegs 161 as shown in FIG. 22. The arrangement is then clamped together by sliding clamping member 163 over the peg.

Figure 23:
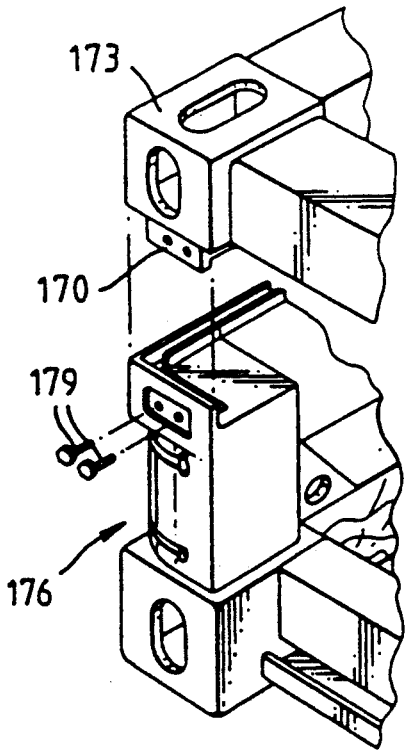
FIG. 23 is an enlarged perspective view of a system of interlocking the base to the top side.
Figure 24:
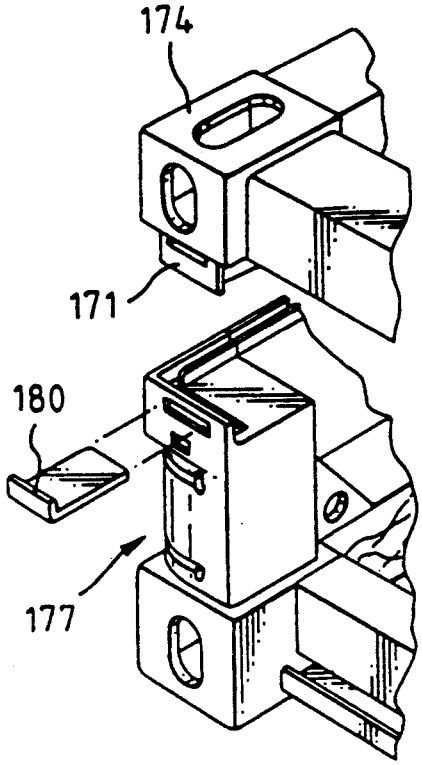
FIG. 24 is an enlarged perspective view of a further system of interlocking the base to the top side.
Figure 25:
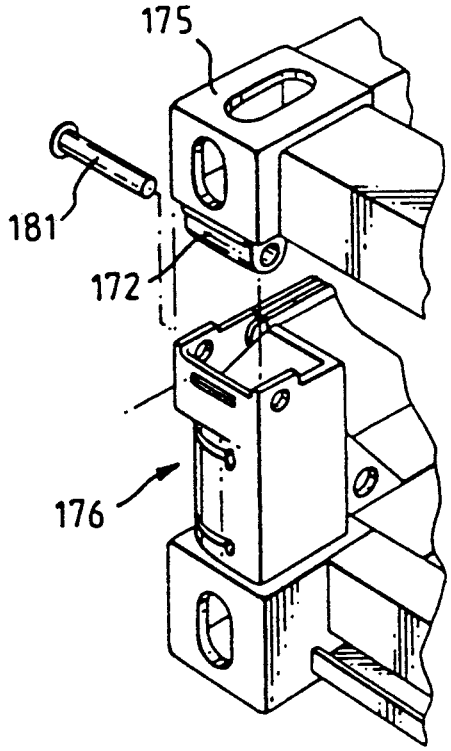
FIG. 25 is an enlarged perspective view of a still further system of interlocking the base to the top side.

FIGS. 23, 24, 25 illustrate various systems of clamping the top wall to the base. In these systems, a slotted extension 170, 171, 172 in the base of the fixing block 173, 174, 175 is accommodated in a recess formed in the top of the adjacent plinth 176, 177, 178 and is locked thereto by pins 179, 180, 181.

Figure 26:
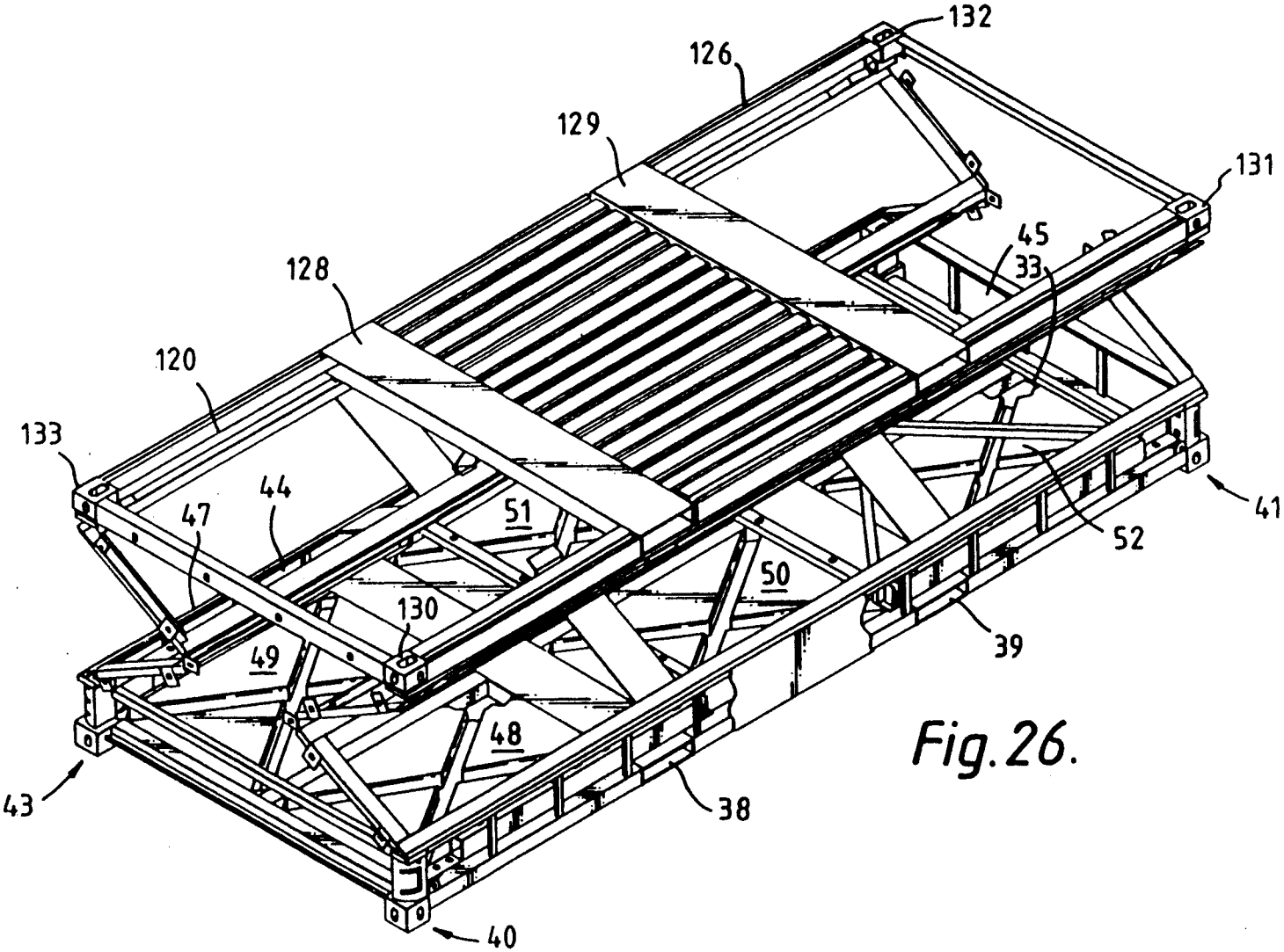
FIG. 26 is a perspective view of the container of FIG. 2 in a semi-collapsed state.

FIG. 26 is a perspective view showing how the side walls of the container fold during collapsing or erection.

Figure 27:
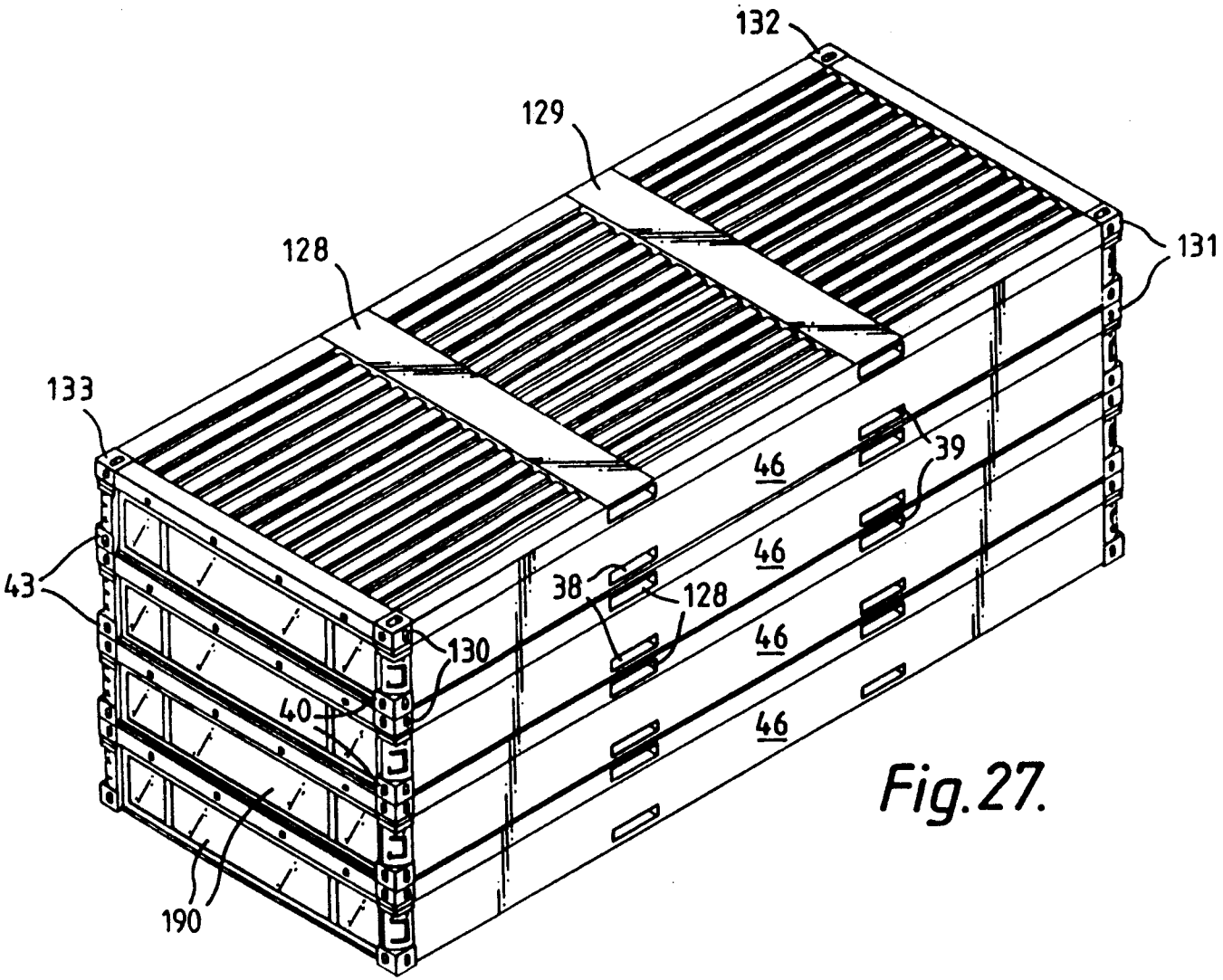
FIG. 27 is a perspective view of four collapsed containers of the type illustrated in FIG. 1, in stacked arrangement.

FIG. 27 is an illustration of how the collapsed containers of the invention may be stacked together.

Figure 28:
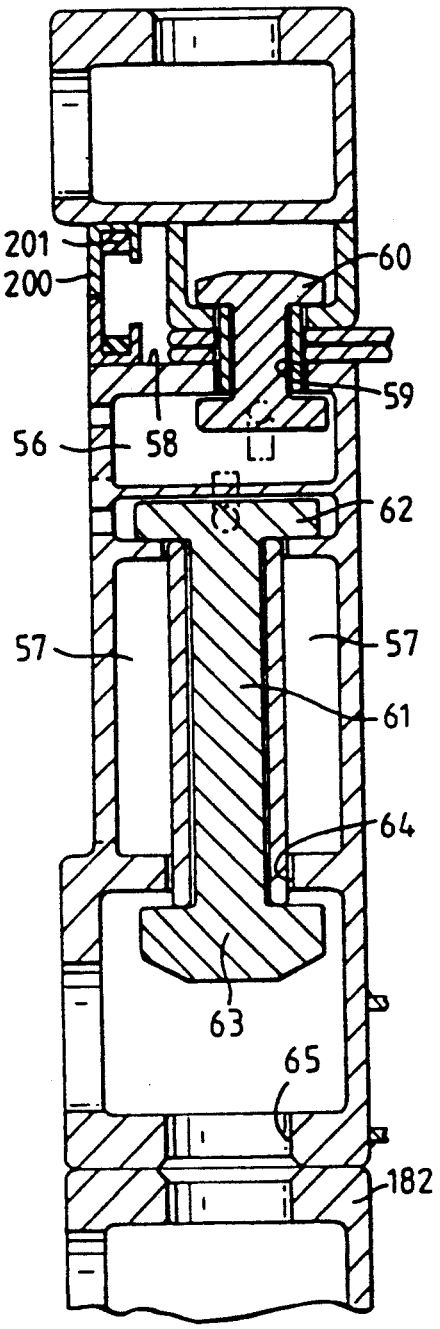
FIG. 28 is a sectionalized view of a collapsed stacked container as illustrated in FIG. 27 with a lower pin in a stowed location.
Figure 29:
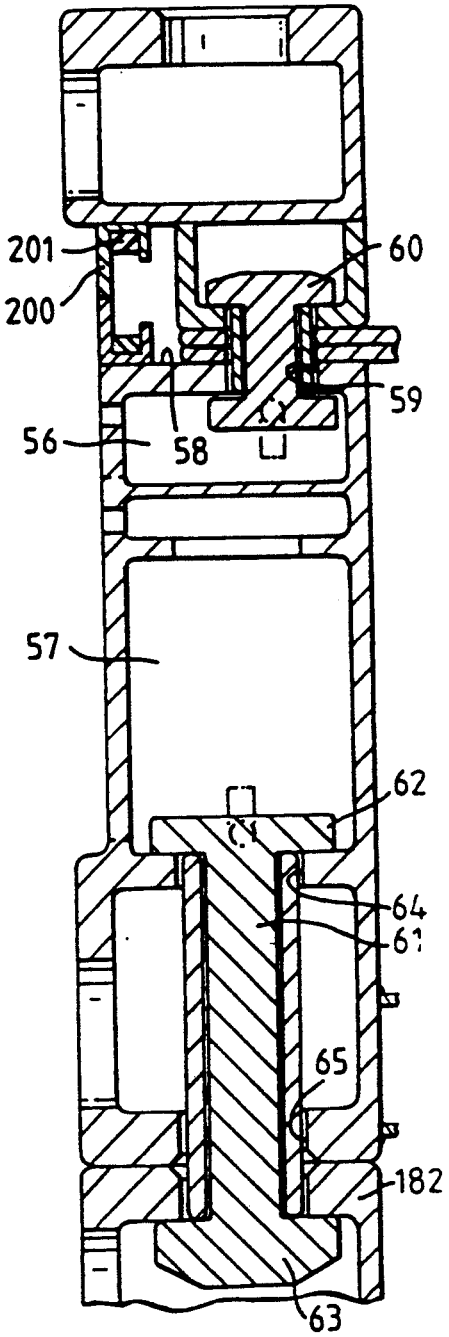
FIG. 29 is a sectionalized view similar to FIG. 28 but with the lower pin locked into a container below.

FIGS. 28 and 29 illustrate the locking together of two stacked and collapsed containers illustrated in FIG. 27. This is achieved by rotating the locking pin 61 of FIG. 28, moving it down through opening 65 into the fixing block 182 of an adjacent container as shown in FIG. 29 and rotating the pin to a locking position.

Figure 20:
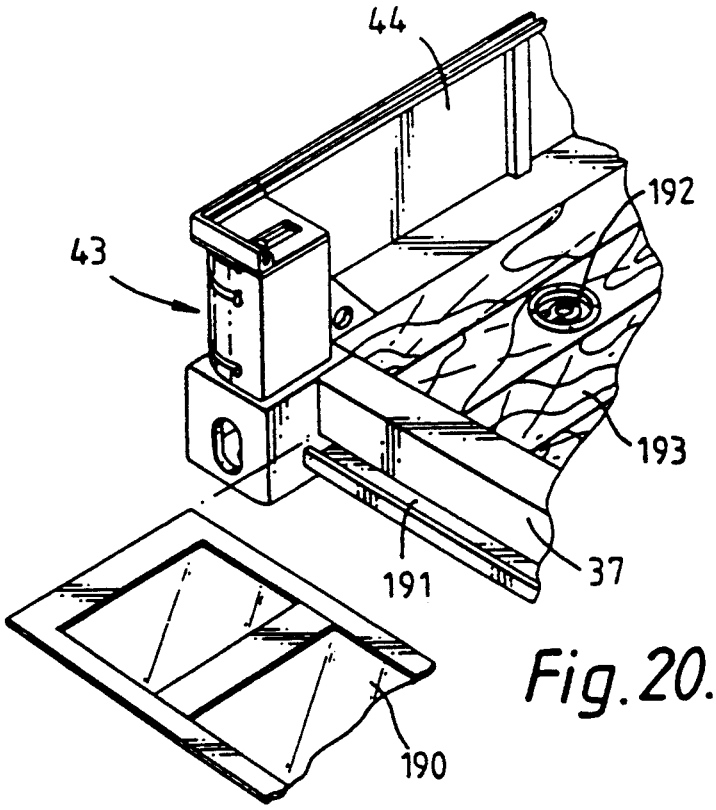
FIG. 20 is a partial perspective view of the door end of the container of FIG. 1.

FIG. 20 shows where a viewing panel 190 is stowed beneath the container on support 191. It also shows a typical deck lashing point 192 fitted to an overlay of wooden flooring 193 in the bottom of the base and secured to metal sections of the base.

The collapsible, stackable container thus described may be erected by the following sequence of steps:

1. Rotate the pins 60 in the corner fixing blocks 130, 131, 132, 133 to disengage the top wall from the base.
2. Engage the tyne pockets 128, 129 in the top wall with suitable lifting equipment such as a forklift or crane, and raise the top wall with attached side walls to fully extend the side walls to a vertical location.
3. Secure the catches 156 to retain the sealing flap rigidly against the sidewall hinges.
4. Disengage the lifting equipment from the tyne pockets.
5. Raise an end wall by connecting an upper part of it to the lifting equipment and pivoting the wall up onto its plinth.
6. Lift the pins in the plinths and engage in the associated corner posts by rotation.
7. Hammer the wedge/peg sliding locks into position to complete the lock and comprises rubber seals on all side of the door frame.
8. Repeat procedure 5, 6, 7 for the other end of the container.

The container is now upright and sealed against the elements on all sides.

We claim:

1. A collapsible box container having a base, two end walls, a top wall and two side walls; said base comprising a rigid reinforced rectangular structure with two opposing skirting walls and internal plinths at each corner terminating below the upper edges of the skirting walls, said base including forklift tyne pockets extending through the opposing skirting walls; said end walls each comprising a rigid reinforced structure including integral side posts which form the load transmitting features of the erected container and which are supported by said plinths and locked thereto by keying elements located within the plinths, said side posts having an inner facing pivoting arrangement to permit pivoting of the end walls inwardly of the container; said top wall comprising a rectangular reinforced structure and a fixing block at each corner; said side walls each comprising two rigid reinforced rectangular sidewall structures longitudinally hingedly connected to one another and also hingedly connected to the inner edge of an adjacent skirting wall and a reinforced longitudinal edge of the top wall; whereby the container is collapsible by fractionally raising the top wall, unlocking the side posts from the plinths, pivoting each end wall inwardly of the container so that it assumes a horizontal position between the skirting walls, lowering the top wall while simultaneously collapsing the side walls inwardly of the container so that the rigid reinforced rectangular sidewall structures of each side wall fold into two face-to-face sections lying between the skirting walls, said opposing skirting walls and said top wall having interior surfaces defining an interior space therebetween, said collapsed side walls lying entirely within said interior space, and the perimeter of the top wall being substantially coplanar with the outer sides of the skirting walls and in sealed relationship thereto when the container is collapsed.

2. A collapsible box container as claimed in claim 1 and including a third skirting wall interconnecting the two opposing skirting walls.

3. A collapsible box container as claimed in claim 1 and including a "J-angle" extrusion integral with the upper edge of the skirting walls wherein the shank of the "J" extends upwardly and coplanarly with the outer face of the associated skirting wall.

4. A collapsible box container as claimed in claim 3 and including a resiliently deformable sealing strip within the "J-angle" extrusion.

5. A collapsible box container as claimed in claim 1, wherein the rigid reinforced structure of the base comprises a box beam perimeter with the internal plinths at the corners thereof and the forklift tyne pockets intersecting the perimeter box beams at two locations symmetrical with the mid-point of the longitudinal edges of the base.

6. A collapsible box container as claimed in claim 5, and wherein the rigid reinforced structure of the base further includes a network of reinforcing sections including the perimeter box beams, and spaces between the reinforcing sections accommodate one or more pressed metal panels.

7. A collapsible box container as claimed in claim 1, wherein the plinths are hollow metal castings which incorporate in their lower section a fitting for connecting to an adjacent container and in their upper section a peg housing for locking a corner post thereto.

8. A collapsible box container as claimed in claim 7, wherein the peg in the upper section is manipulable between a housed position within the upper section and a partially extended position therefrom, by means of a lever extended through a slotted groove in the side of said upper section; said lever being arranged so as to enable rotation of the peg when in a partially extended position for the purpose of locking to the corner post.

9. A collapsible box container as claimed in claim 7, and wherein the upper section also includes a secondary housing for accommodating a mating element formed as an extension of the fixing block of the top wall for the purpose of locking the top wall to the base.

10. A collapsible box container as claimed in claim 9, wherein the secondary housing and the mating element are interlocked by a pin.

11. A collapsible box container as claimed in claim 1, wherein the pivoting arrangement on each side post comprises an angle-iron profile extending from the base of the post on which a curved inwardly facing surface is provided for hinged attachment to locating rings formed integrally with the base adjacent each plinth.

12. A collapsible box container as claimed in claim 1, wherein one of the end walls incorporates a doorway; said doorway including two outwardly opening doors hingedly connected to opposite side posts.

13. A collapsible box container as claimed in claim 12, wherein the other of the two end walls is a fixed wall.

14. A collapsible box container as claimed in claim 1, wherein the top wall is fabricated from reinforcing members including angle profile metal members along the perimeter of the top wall, intersected by case metal fittings at each corner forming said fixing blocks, and box section tyne locating pockets symmetrically arranged to extend between the longer sides of said top wall; and wherein spaces between the reinforcing members of the top wall contain one or more pressed metal plates.

15. A collapsible box container as claimed in claim 1, and including a sealing flap on the inside of each side wall which overlaps with the longitudinal hinging region between the two rigid reinforced sidewall structures.

16. A collapsible box container as claimed in claim 15, wherein the sealing flap is fabricated from pressed metal and is profiled to snugly fit over the hinging region when the side walls of the container are erected.

17. A collapsible box container as claimed in claim 16, wherein the lower longitudinal edge of the sealing flap is permanently fixed to the upper inner edge of the lower one of the sidewall structures of each side wall and is adapted for firm retention against the lower inner edge of the upper one of the side wall structures by clip means.

18. A collapsible box container as claimed in claim 1, which has the dimensions, when erected of a standard shipping container.

19. A collapsible box container as claimed in claim 1, which, when collapsed, takes up approximately one quarter of the space of the container when erected.

20. A collapsible box container as claimed in claim 1, wherein the rectangular reinforced structure of the top wall includes forklift tyne pockets.

* * * * *